US010388229B2

(12) United States Patent
Park et al.

(10) Patent No.: US 10,388,229 B2
(45) Date of Patent: Aug. 20, 2019

(54) METHOD FOR COMPENSATING IMAGE INFORMATION

(71) Applicant: SAMSUNG DISPLAY CO., LTD., Yongin-si, Gyeonggi-do (KR)

(72) Inventors: Jin-Woo Park, Yongin-si (KR); Sung-Hoon Bang, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 16/170,422

(22) Filed: Oct. 25, 2018

(65) Prior Publication Data

US 2019/0066602 A1 Feb. 28, 2019

Related U.S. Application Data

(62) Division of application No. 14/927,744, filed on Oct. 30, 2015, now Pat. No. 10,121,417.

(30) Foreign Application Priority Data

Jan. 27, 2015 (KR) ..... 10-2015-0012538

(51) Int. Cl.
*G09G 5/10* (2006.01)
*G09G 3/3283* (2016.01)
(Continued)

(52) U.S. Cl.
CPC ..... *G09G 3/3283* (2013.01); *G09G 3/2003* (2013.01); *G09G 3/3208* (2013.01);
(Continued)

(58) Field of Classification Search
CPC .. G09G 3/3283; G09G 3/3208; G09G 3/2003; G09G 2320/0673;
(Continued)

(56) References Cited

U.S. PATENT DOCUMENTS

2005/0110786 A1 5/2005 Inoue et al.
2008/0231557 A1 9/2008 Naugler et al.
(Continued)

FOREIGN PATENT DOCUMENTS

EP 1 231 592 A2 8/2002
KR 10-2006-0128464 A 12/2006
(Continued)

OTHER PUBLICATIONS

European Search Report dated Feb. 10, 2016 in Corresponding European Patent Application No. 15187582.0.

*Primary Examiner* — Rodney Amadiz
(74) *Attorney, Agent, or Firm* — Lee & Morse, P.C.

(57) ABSTRACT

A method for controlling a display panel includes calculating an on-pixel ratio based on gamma information corresponding to image information, providing maximum current information based on a dimming level, calculating an average current of the display panel based on the on-pixel ratio and the maximum current information, and providing pixel average current information for each of a plurality of pixels in the display panel. The on-pixel ratio is based on the turned-on pixels of the pixels in the display panel. The pixel average current information is determined based on the average current of the display panel.

4 Claims, 13 Drawing Sheets

(51) Int. Cl.
*G09G 3/20* (2006.01)
*G09G 3/3208* (2016.01)

(52) U.S. Cl.
CPC ..... *G09G 2320/0233* (2013.01); *G09G 2320/0271* (2013.01); *G09G 2320/0276* (2013.01); *G09G 2320/048* (2013.01); *G09G 2320/0673* (2013.01); *G09G 2330/021* (2013.01); *G09G 2360/16* (2013.01)

(58) Field of Classification Search
CPC ..... G09G 2320/048; G09G 2320/0271; G09G 2360/16; G09G 2320/0233; G09G 2320/0276; G09G 2330/021
See application file for complete search history.

(56) References Cited

U.S. PATENT DOCUMENTS

| | | | | |
|---|---|---|---|---|
| 2011/0169873 | A1* | 7/2011 | Sano ..... | G09G 3/3426 345/690 |
| 2013/0057595 | A1 | 3/2013 | Nathan et al. | |
| 2014/0028734 | A1 | 1/2014 | Fujishiro | |

FOREIGN PATENT DOCUMENTS

| | | | |
|---|---|---|---|
| KR | 10-2008-0095462 | A | 10/2008 |
| KR | 10-2014-0079690 | A | 6/2014 |

* cited by examiner

PIXEL AVERAGE CURRENT LUT(PACLT)

| FRAME | F1 | F2 | F3 |
|---|---|---|---|
| PC | 5 | 0 | 4 |
| PAC1 | 5 | 5 | 3 |

| DIMMING LEVEL(DL) | MAX CURRENT (MC) |
|---|---|
| 0 | 0 |
| 1 | 10 |
| 2 | 50 |
| 3 | 100 |

MAX CURRENT LUT (MCLT)

METHOD FOR COMPENSATING IMAGE INFORMATION

CROSS REFERENCE TO RELATED APPLICATIONS

This is a divisional application based on pending application Ser. No. 14/927,744, filed Oct. 30, 2015, the entire contents of which is hereby incorporated by reference.

Korean Patent Application No. 10-2015-0012538, filed on Jan. 27, 2015, and entitled, "Method Of Extracting Average Current and Method Of Compensating Image Information Including The Same," is incorporated by reference herein in its entirety.

BACKGROUND

1. Field

One or more embodiments described herein relate to a method of extracting average current and a method of compensating image information.

2. Description of the Related Art

As the emitting time of an organic light-emitting diode increases, luminous efficiency may decrease. This may cause display quality to be adversely affected.

SUMMARY

In accordance with one or more embodiments, a method for extracting average current includes calculating an on-pixel ratio based on gamma information corresponding to image information, the on-pixel ratio based on turned-on pixels of a plurality of pixels in a display panel; providing maximum current information based on a dimming level; calculating an average current of the display panel based on the on-pixel ratio and the maximum current information; and providing pixel average current information for each of the pixels, the pixel average current information determined based on the average current of the display panel. The pixel average current information may be determined based on a pixel average current look-up table.

The method may include updating the pixel average current information in the pixel average current look-up table at a predetermined time interval. The predetermined time interval maybe a predetermined frame interval. After the predetermined frame interval, the pixel average current information may not be updated when a current of a corresponding one of the pixels is 0. After the predetermined frame interval, the pixel average current information may be updated when a current of a corresponding one of the pixels is not 0.

The method may include storing the maximum current information corresponding to the dimming level in a max current look-up table. The method may include increasing a maximum current value corresponding to the maximum current information as the dimming level increases. The method may include storing the maximum current information corresponding to the dimming level in the maximum current look-up table before the display panel operates. An average current of the display panel may be less than or equal to a maximum current value corresponding to the maximum current information.

The method may include increasing the average current of the display panel as the on-pixel ratio increases. The method may include increasing the average current of the display panel as the maximum current value corresponding to the maximum current information increases. The method may include determining the average current of the display panel based on a value obtained by multiplying the on-pixel ratio and the maximum current value corresponding to the maximum current information.

The method may include calculating a light emitting area of the display panel; and changing the pixel average current look-up table based on the light emitting area of the display panel. Deviation among the pixel average current information for the pixels may be directly proportional to the light emitting area of the display panel.

In accordance with one or more other embodiments, a method for compensating image information includes calculating an on-pixel ratio based on gamma information corresponding to image information, the on-pixel ratio based on turned-on pixels among a plurality of pixels in a display panel; providing maximum current information corresponding to a dimming level; calculating an average current of the display panel based on the on-pixel ratio and the maximum current information; determining pixel average current information for each of the pixels based on the average current of the display panel; and compensating the gamma information corresponding to the image information based on the pixel average current information for each of the pixels.

The method may include generating a compensation constant for compensating the gamma information based on the pixel average current information for each of the pixels. The method may include storing the pixel average current information for each of the pixels in a pixel average current look-up table; and updating the pixel average current information in the pixel average current look-up table at a predetermined time interval. The method may include storing the maximum current information corresponding to the dimming level in a maximum current look-up table, and increasing a maximum current value corresponding to the maximum current information as the dimming level increases.

In accordance with one or more other embodiments, an apparatus includes an on-pixel calculator to calculate an on-pixel ratio based on gamma information corresponding to image information, the on-pixel ratio based on turned-on pixels among a plurality of in a display panel; a maximum current information provider to provide maximum current information corresponding to a dimming level; an average current calculator to calculate an average current of the display panel based on the on-pixel ratio and the maximum current information; and a pixel information provider to provide pixel average current information for each of the pixels, the pixel average current information determined based on the average current of the display panel.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
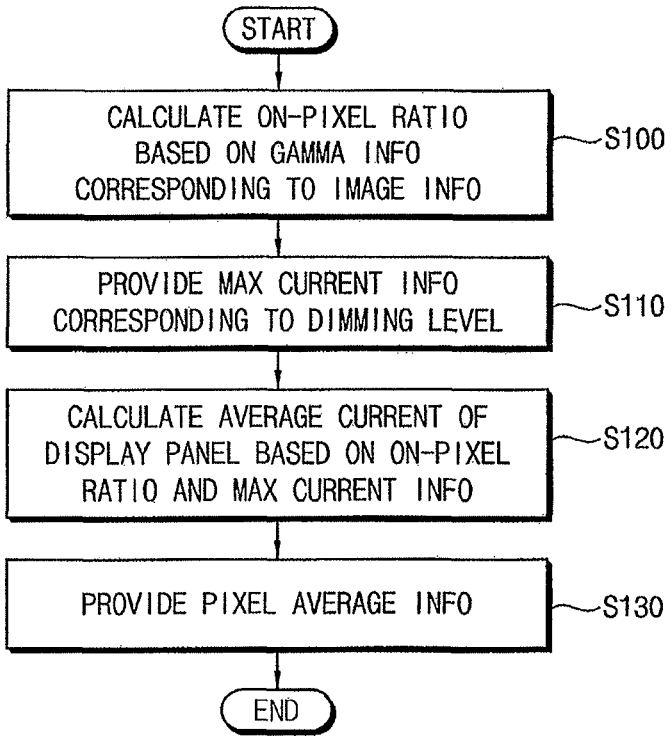
FIG. 1 illustrates an embodiment of a method for extracting average current.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
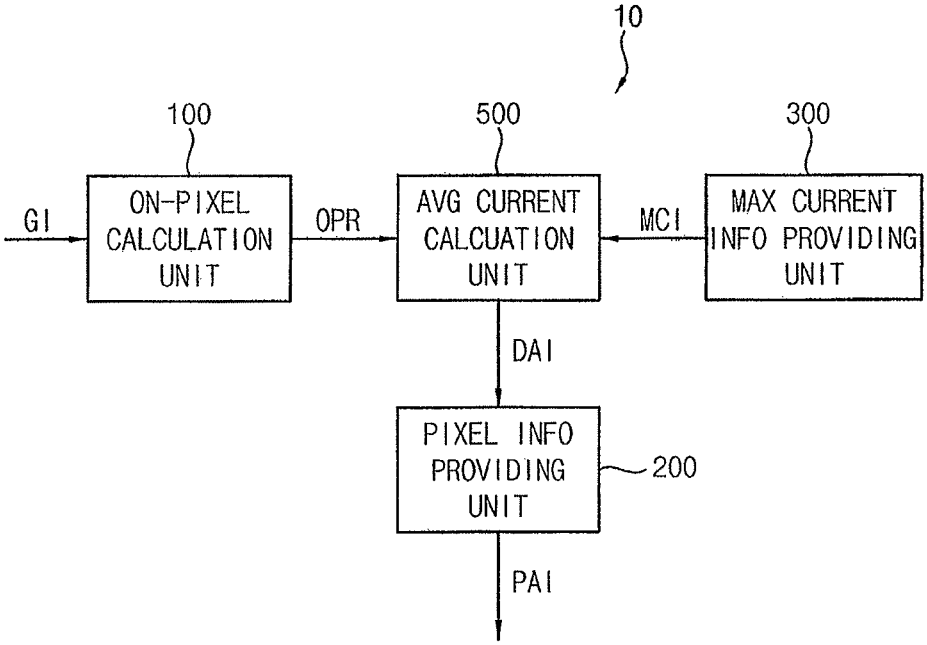
FIG. 2 illustrates an embodiment of an average current extraction device.

FIG. 1 illustrates an embodiment of a method for extracting average current, and FIG. 2 illustrates an embodiment of an average current extraction device 10. Referring to FIGS. 1 and 2, an average current extraction device 10 includes an on-pixel calculation unit 100, a max current info providing unit 300, an average current calculation unit 500 and a pixel info providing unit 200.

In the method for extracting an average current, the on-pixel calculation unit 100 calculates an on-pixel ratio OPR based on a gamma info GI corresponding to image info IMI (S100). The on-pixel ratio OPR corresponds to turned-on pixels in a display panel DP. As will be described in FIGS. 10 to 12, the pixels in the display panel DP may be turned-on based the gamma info GI corresponding to the image info IMI. For example, in case all pixels in the display panel DP display white color based the gamma info GI corresponding to the image info IMI, the on-pixel ratio OPR may be 1 or 100%. In the case where half of the pixels in the display panel DP display white color based the gamma info GI corresponding to the image info IMI, the on-pixel ratio OPR may be 0.5 or 50%. In the case where three quarters of the pixels in the display panel DP display white color based the gamma info GI corresponding to the image info IMI, the on-pixel ratio OPR may be 0.75 or 75%.

The max current info providing unit 300 provides max current info MCI corresponding to a dimming level DL (S110). The max current info MCI may be, for example, a max current MC corresponding to the dimming level DL. As will be described with reference to FIG. 9, the max current info MCI of the display panel DP may be changed according to the dimming level DL of the display device including the display panel DP. As dimming level DL increases, the max current MC corresponding to the max current info MCI of the display panel DP may increase. For example, when dimming level DL of the display device including the display panel DP is 1, the max current MC corresponding to the max current info MCI of the display panel DP may be 10. When the dimming level DL is 3, the max current MC corresponding to the max current info MCI of the display panel DP may be 100.

The average current calculation unit 500 calculates an average current DAI of the display panel DP based on the on-pixel ratio OPR and the max current info MCI (S120). The average current DAI of the display panel DP may be a value based on multiplying the on-pixel ratio OPR and the max current MC value corresponding to the max current info MCI. For example, the on-pixel ratio OPR may be 1 and the dimming level DL may be 1. When the dimming level DL is 1, the max current MC corresponding to the max current info MCI may be 10. In this case, the average current DAI of the display panel DP may be 10. The value obtained by multiplying the on-pixel ratio OPR and the max current MC value corresponding to the max current info MCI may be 10. In addition, the on-pixel ratio OPR may be 0.5 and the dimming level DL may be 1.

When the dimming level DL is 1, the max current MC corresponding to the max current info MCI may be 10. In this case, the average current DAI of the display panel DP may be 5. The value obtained by multiplying the on-pixel ratio OPR and the max current MC value corresponding to the max current info MCI may be 5. In addition, the on-pixel ratio OPR may be 0.5 and the dimming level DL may be 3.

When the dimming level DL is 3, the max current MC corresponding to the max current info MCI may be 100. In this case, the average current DAI of the display panel DP may be 50. The value obtained by multiplying the on-pixel ratio OPR and the max current MC value corresponding to the max current info MCI may be 50.

The pixel info providing unit 200 provides pixel average current info PAI for each of the pixels (S130). The pixel average current info PAI is determined by the average current DAI of the display panel DP. As will be described with reference to FIG. 5, the pixel average current PAC for each of the pixels may be changed according to the average current DAI of the display panel DP. When the average current DAI of the display panel DP is determined, the pixel average current PAC for each of the pixels in the display panel DP may be determined. The pixel average current info PAI for each of the pixels in the display panel DP may be stored in a pixel average current look-up table PACLT.

The method for extracting average current may compensate the image degradation of the display panel DP by providing the pixel average current info PAI for each of the pixels based on the average current DAI of the display panel DP.

Figure 3:
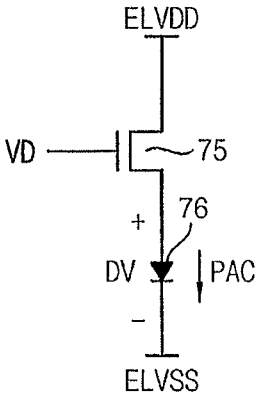
FIGS. 3 and 4 illustrate examples of degradation based on pixel average current.
Figure 4:
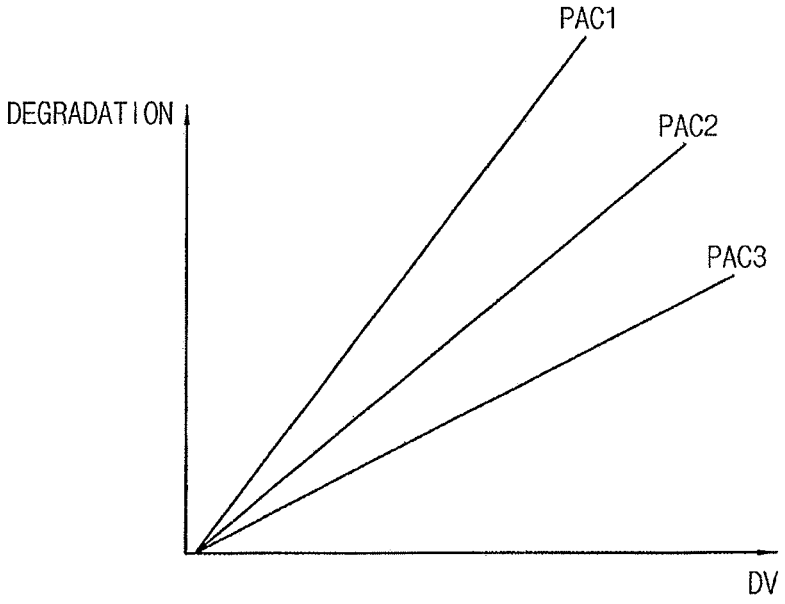

FIGS. 3 and 4 illustrate examples for describing degradation based on pixel average current PAC. Referring to FIGS. 3 and 4, when a transistor 75 is turned-on based on the data voltage VD, current is transferred through an organic light-emitting diode 76. The degree of degradation of the pixel may be different according to the pixel average current PAC transferred through the organic light-emitting diode 76. For example, the pixel average current PAC transferred through the organic light-emitting diode 76 may be a first pixel average current PAC1. The pixel average current PAC transferred through the organic light-emitting diode 76 may be a second pixel average current PAC2. The pixel average current PAC transferred through the organic light-emitting diode 76 may be a third pixel average current PAC3. The first pixel average current PAC1 may be greater than the second pixel average current PAC2. The second pixel average current PAC2 may be greater than the third pixel average current PAC3.

The degree of degradation of the pixel may increase as the pixel average current PAC transferred through the organic light-emitting diode 76 increases. For example, when the pixel average current PAC transferred through the organic light-emitting diode 76 is the first pixel average current PAC1, the degree of degradation of the pixel may be highest. When the pixel average current PAC transferred through the organic light-emitting diode 76 is the second pixel average current PAC2, the degree of degradation of the pixel may be second highest. When the pixel average current PAC transferred through the organic light-emitting diode 76 is the third pixel average current PAC3, the degree of degradation of the pixel may be lowest. The degree of degradation of the pixel may be different according to the pixel average current PAC transferred through the organic light-emitting diode 76.

Figure 5:
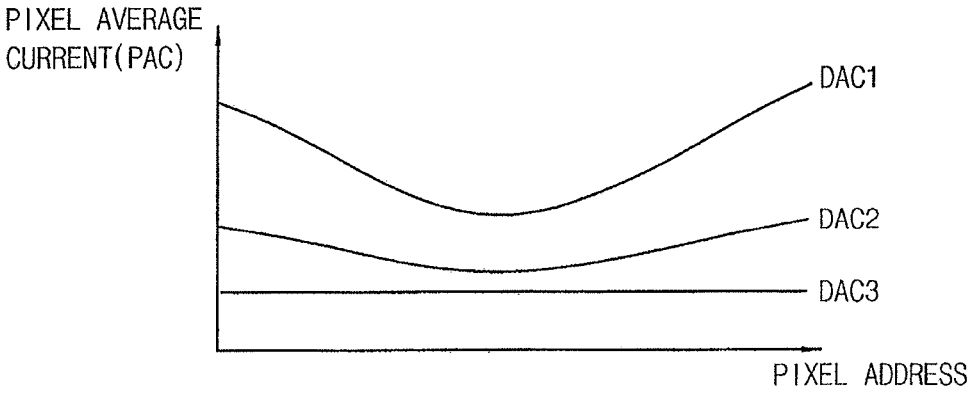
FIG. 5 illustrates an example of a pixel average current look-up table.

FIG. 5 illustrates an example corresponding to a pixel average current look-up table. Referring to FIG. 5, the pixel average current PAC for each of the pixels may be changed according to the average current DAI of the display panel DP. When the average current DAI of the display panel DP is determined, the pixel average current PAC for each of the pixels in the display panel DP may be determined. The pixel average current info PAI for each of the pixels in the display panel DP may be stored in a pixel average current look-up table PACLT.

For example, the average current DAI of the display panel DP may be a first average current DAC1. In this case, as the pixel address is increased, the pixel average current PAC may be increased after the pixel average current PAC is decreased. The average current DAI of the display panel DP may be a second average current DAC2. In this case, as the pixel address is increased, the pixel average current PAC may be increased after the pixel average current PAC is decreased. Also, in this case, the range of the pixel average current PAC in the second average current DAC2 may be less than the range of the pixel average current PAC in the first average current DAC1. The average current DAI of the display panel DP may be a third average current DAC3. In this case, as the pixel address is increased, the pixel average current PAC may be constant.

The pixel average current info PAI for each of the pixels according to the average current DAI of the display panel DP may be stored in a pixel average current look-up table PACLT. In one embodiment, the pixel info providing unit 200 may include the pixel average current look-up table PACLT for storing pixel average current info PAI for each of the pixels.

The method for extracting average current may compensate image degradation of the display panel DP by providing the pixel average current info PAI for each of the pixels based on the average current DAI of the display panel DP.

Figures 6, 7:
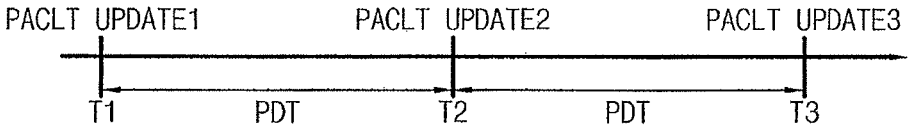
FIG. 6 illustrates an example of updating pixel average current information.
FIGS. 7 and 8 illustrate additional examples of updating pixel average current information.

FIG. 6 illustrates an example for updating pixel average current in the pixel average current look-up table PACLT. Referring to FIG. 6, the pixel average current info PAI in the pixel average current look-up table PACLT may be updated at predetermined time intervals PDT. For example, in a first time T1, the average current extraction device 10 may update the pixel average current info PAI in the pixel average current look-up table PACLT based on a first pixel current PC1. The first pixel current PC1 may be a current transferred to the organic light-emitting diode 76 in the first time T1. In a second time T2, the average current extraction device 10 may update the pixel average current info PAI in the pixel average current look-up table PACLT based on a second pixel current PC2. The second pixel current PC2 may be a current transferred to the organic light-emitting diode 76 in the second time T2. In a third time T3, the average current extraction device 10 may update the pixel average current info PAI in the pixel average current look-up table PACLT based on a third pixel current PC. The third pixel current PC may be a current transferred to the organic light-emitting diode 76 in the third time T3. The time interval between the first time T1 and the second time T2 may be the predetermined time interval PDT. Also, the time interval between the second time T2 and the third time T3 may be the predetermined time interval PDT. These intervals may be different in another embodiment.

The method for extracting average current may compensate image degradation of the display panel DP by providing the pixel average current info PAI for each of the pixels based on the average current DAI of the display panel DP.

Figures 8, 9:
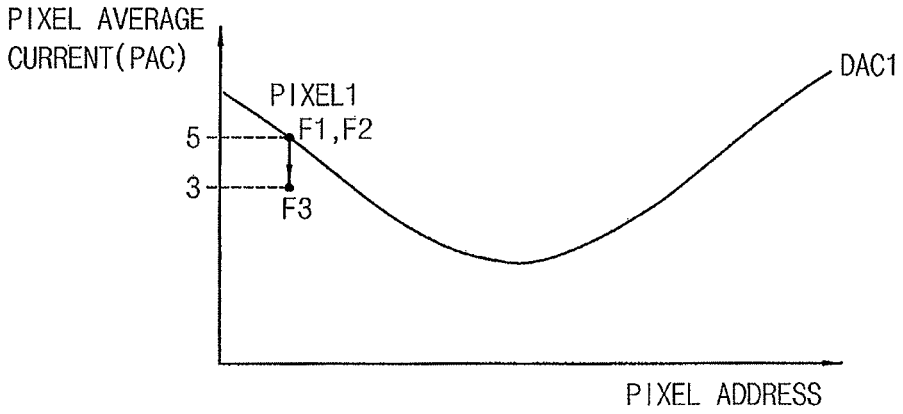
FIG. 9 illustrates an example of a max current look-up table.

FIGS. 7 and 8 illustrate additional examples for updating pixel average current info in a pixel average current look-up table. Referring to FIGS. 7 and 8, the predetermined time interval PDT may be a predetermined frame interval. In this embodiment, the pixel average current look-up table PACLT may be updated. After the predetermined frame interval, when a current of the pixel is 0, the pixel average current info PAI for the pixel may not be updated. For example, the predetermined frame interval may be one frame interval.

In a first frame F1, the first pixel current PC1 transferred to the organic light-emitting diode 76 in the first pixel PIXEL1 may be 5. In this case, the first pixel average current PAC1 may be 5. When the first pixel average current PAC1 is 5, the pixel average current info PAI corresponding to the first pixel average current PAC1 in the pixel average current look-up table PACLT may be updated to 5.

In a second frame F2, the second pixel current PC2 transferred to the organic light-emitting diode 76 in the first pixel PIXEL1 may be 0. In case the first pixel current PC1 that is transferred to the organic light-emitting diode 76 included in the first pixel PIXEL1 is 0 in the first frame F1, the second pixel average current PAC2 may be 5. After the predetermined frame interval, when the current of the pixel is 0, the pixel average current info PAI for the pixel may not be updated.

In one embodiment, the pixel average current look-up table PACLT may be updated. After the predetermined frame interval, if the current of the pixel is not 0, the pixel average current info PAI for the pixel may be updated.

For example, in a third frame F3, the third pixel current PC transferred to the organic light-emitting diode 76 in the first pixel PIXEL1 may be 4. In case the third pixel current PC that is transferred to the organic light-emitting diode 76 included in the first pixel PIXEL1 is 4 in the third frame F3, the third pixel average current PAC3 may be (5+4)/3=3. When the third pixel average current PAC3 is 3, the pixel average current info PAI corresponding to the third pixel average current PAC3 in the pixel average current look-up table PACLT may be updated to 3.

As a result, the pixel average current info PAI for the first pixel PIXEL1 may be updated to 5 in the first frame F1. The pixel average current info PAI for the first pixel PIXEL1 may not be updated in the second frame F2. The pixel average current info PAI for the first pixel PIXEL1 may be updated to 3 in the third frame F3.

The method for extracting average current may compensate image degradation of the display panel DP by providing the pixel average current info PAI for each of the pixels based on the average current of the display panel DP.

Figure 10:
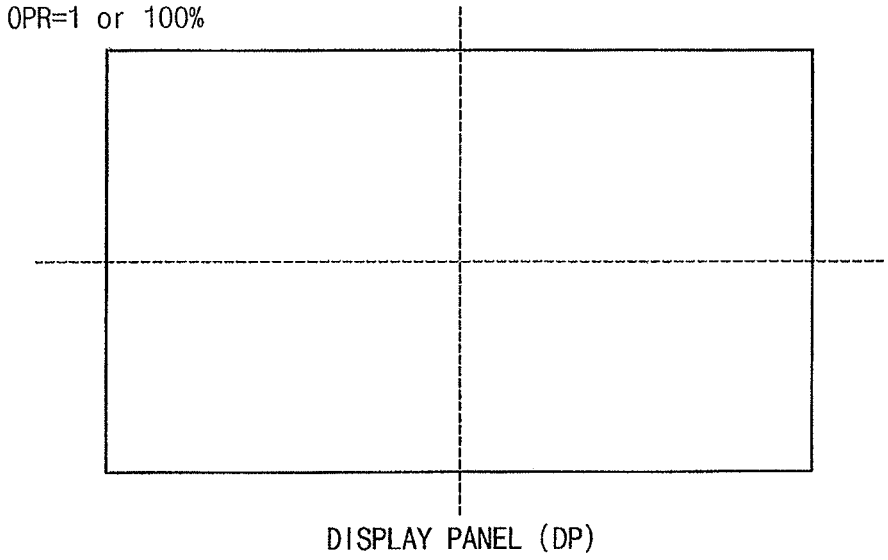
FIG. 10 illustrates an example of a max current value corresponding to max current information.

FIG. 9 illustrates an example of a max current look-up table, and FIG. 10 illustrates an example for describing a max current value corresponding to max current info. Referring to FIG. 9, the max current info providing unit 300 may include a max current look-up table MCLT that stores the max current info MCI corresponding to the dimming level DL. The max current info MCI corresponding to the dimming level DL may be stored in the max current look-up table MCLT before the display panel DP operates. As the dimming level DL is increased, a max current MC value corresponding to the max current info MCI may be increased.

For example, when the dimming level DL of the display device including the average current extraction device 10 is 0, the max current MC corresponding to the max current info MCI may be 0. When the dimming level DL of the display device including the average current extraction device 10 is 1, the max current MC corresponding to the max current info MCI may be 10.

When the dimming level DL of the display device including the average current extraction device 10 is 2, the max current MC corresponding to the max current info MCI may be 50. When the dimming level DL of the display device including the average current extraction device 10 is 3, the max current MC corresponding to the max current info MCI may be 100.

Therefore, as the dimming level DL is increased, a max current value corresponding to the max current info MCI may be increased. The max current MC corresponding to the max current info MCI may be used to calculate the average current DAI of the display panel DP.

Referring to FIGS. 9 and 10, the on-pixel ratio OPR may be 1. When the dimming level DL of the display device is 1, the max current MC corresponding to the max current info MCI may be 10. In this case, the average current DAI of the display panel DP may be 10. In addition, when the dimming level DL of the display device is 2, the max current MC corresponding to the max current info MCI may be 50. In this case, the average current DAI of the display panel DP may be 50. In addition, when the dimming level DL of the display device is 3, the max current MC corresponding to the max current info MCI may be 100. In this case, the average current DAI of the display panel DP may be 100.

Figure 11:
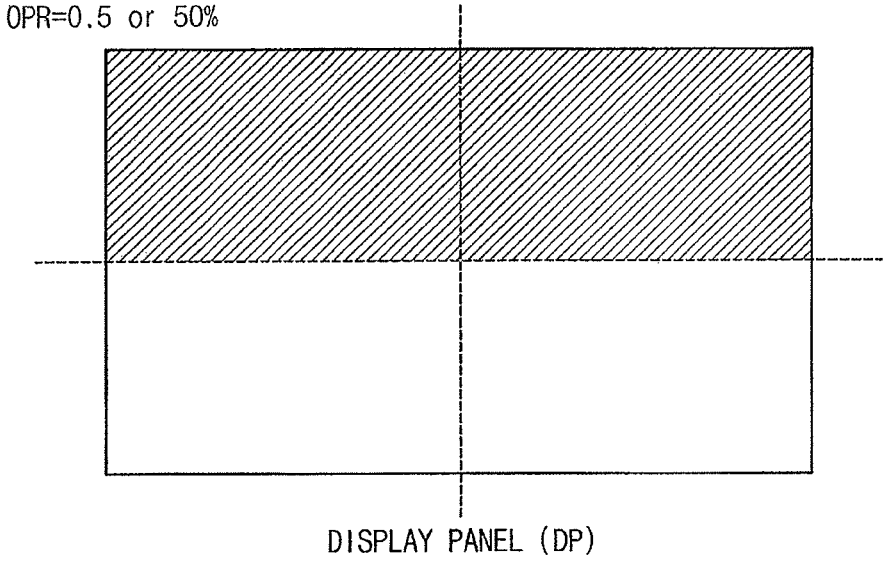
FIGS. 11 and 12 illustrate examples for describing average current of a display panel based on on-pixel ratio.
Figure 12:
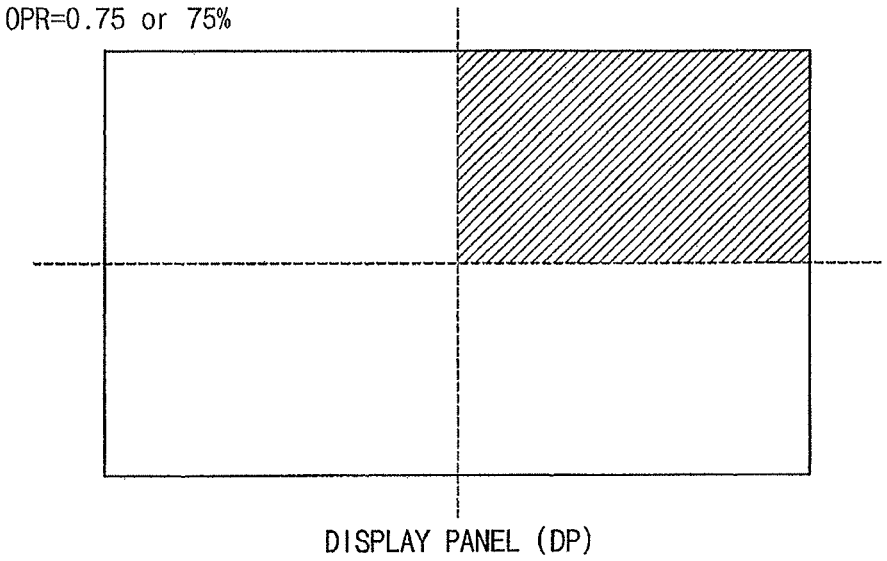

FIGS. 11 and 12 illustrate examples for describing average current of a display panel according to an on-pixel ratio. Referring to FIGS. 9, 11, and 12, an average current DAI of the display panel DP may be less than or equal to a max current MC value corresponding to the max current info MCI. For example, when the on-pixel ratio OPR is 1, the average current DAI of the display panel DP may be equal to the max current MC corresponding to the max current info MCI. When the on-pixel ratio OPR is less than 1, the average current DAI of the display panel DP may be less than the max current MC corresponding to the max current info MCI.

In one embodiment, as the on-pixel ratio OPR is increased, the average current DAI of the display panel DP may be increased. For example, when the dimming level DL of the display device is 3, the max current MC corresponding to the max current info MCI may be 100. When the dimming level DL of the display device is 3 and the on-pixel ratio OPR is 0.5, the average current DAI of the display panel DP may be 50. When the dimming level DL of the display device is 3 and the on-pixel ratio OPR is 0.75, the average current DAI of the display panel DP may be 75. Therefore, as the on-pixel ratio OPR is increased, the average current DAI of the display panel DP may be increased.

In one embodiment, as the max current MC value corresponding to the max current info MCI is increased, the average current DAI of the display panel DP may be increased. For example, the on-pixel ratio OPR may be 0.5 and the dimming level DL may be 1. When the dimming level DL is 1, the max current MC corresponding to the max current info MCI may be 10. In this case, the average current DAI of the display panel DP may be 5. In addition, the on-pixel ratio OPR may be 0.5 and the dimming level DL may be 2.

When the dimming level DL is 2, the max current MC corresponding to the max current info MCI may be 50. In this case, the average current DAI of the display panel DP may be 25. In addition, the on-pixel ratio OPR may be 0.5 and the dimming level DL may be 3.

When the dimming level DL is 3, the max current MC corresponding to the max current info MCI may be 100. In this case, the average current DAI of the display panel DP may be 50. The average current DAI of the display panel DP may be a value obtained by multiplying the on-pixel ratio OPR and the max current MC value corresponding to the max current info MCI.

The method for extracting average current may compensate image degradation of the display panel DP by providing the pixel average current info PAI for each of the pixels based on the average current DAI of the display panel DP.

Figure 13:
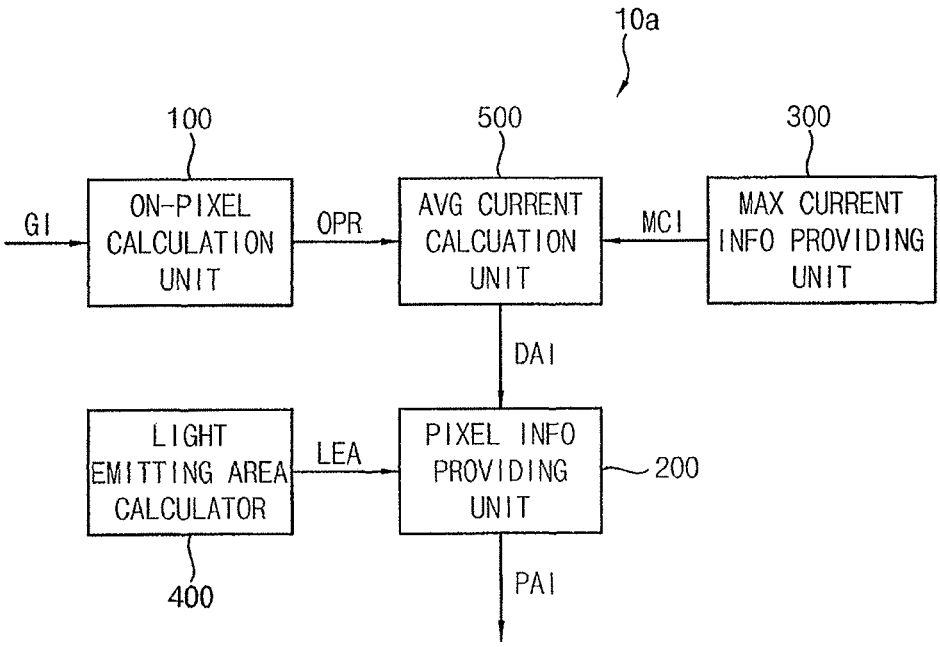
FIG. 13 illustrates another embodiment of an average current extraction device.
Figure 14:
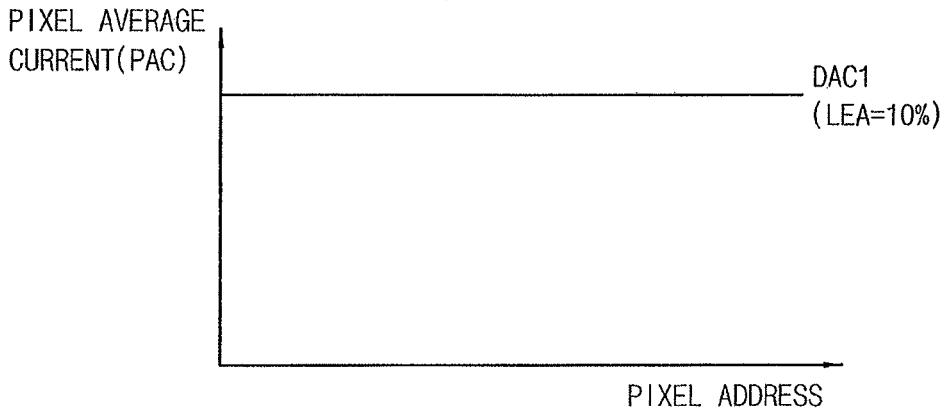
FIGS. 14 to 16 illustrate examples of a pixel average current look-up table based on light emitting area.
Figure 15:
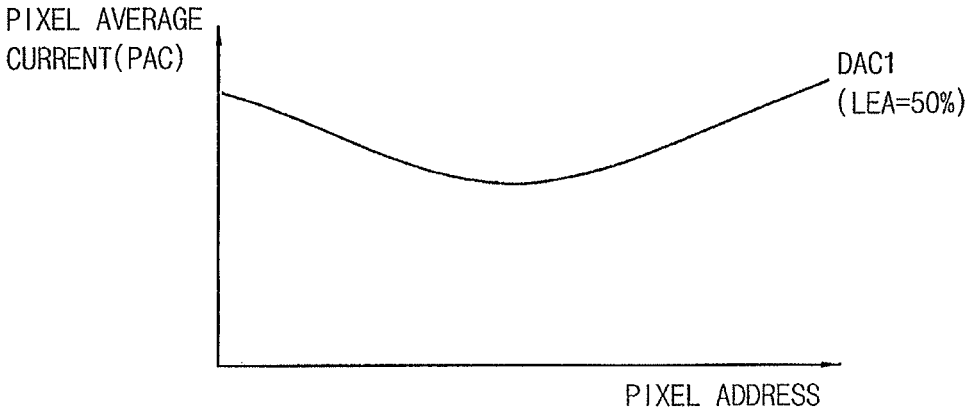
Figure 16:
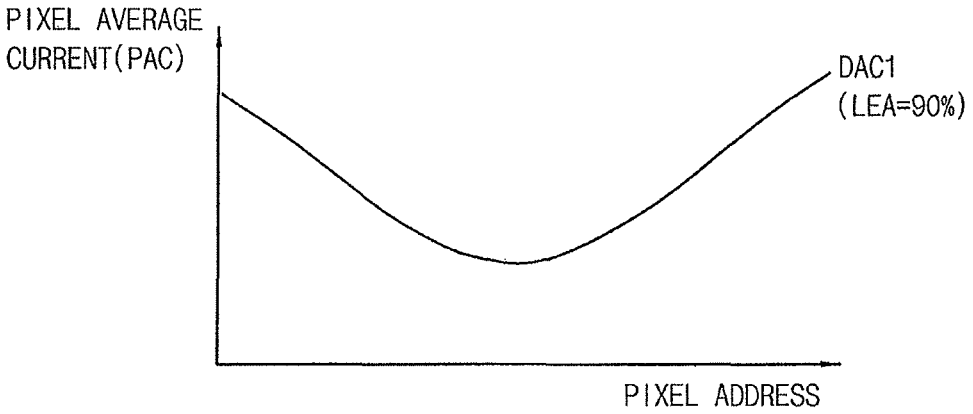

FIG. 13 illustrates another embodiment of an average current extraction device, and FIGS. 14 to 16 illustrate examples corresponding to a pixel average current look-up table according to a light emitting area.

Referring to FIG. 13, an average current extraction device 10*a* includes an on-pixel calculation unit 100, a max current info providing unit 300, an average current calculation unit 500, and a pixel info providing unit 200. The on-pixel calculation unit 100 calculates an on-pixel ratio OPR based on a gamma info GI corresponding to image info IMI. The on-pixel ratio OPR corresponds to turned-on pixels among pixels in a display panel DP. A max current info providing unit 300 provides a max current info MCI corresponding to a dimming level DL.

The average current calculation unit 500 calculates an average current of the display panel DP based on the on-pixel ratio OPR and the max current info MCI.

The pixel info providing unit 200 provides a pixel average current info PAI for each of the pixels. The pixel average current info PAI is determined by the average current DAI of the display panel DP.

In one embodiment, a display device including the display panel DP may include a light emitting area calculator 400 to calculate a light emitting area LEA of the display panel DP.

Referring to FIGS. 14 to 16, the pixel info providing unit 200 may change the pixel average current look-up table PACLT based on the light emitting area LEA of the display panel DP. For example, the average current DAI of the display panel DP may be the first average current DAC1. In this case, the pixel average current look-up table PACLT according to the light emitting area LEA may be generated based on the curve for the first average current DAC1 of FIG. 5.

For example, when the light emitting area LEA is 90%, the pixel average current look-up table PACLT may be similar to the curve for the first average current DAC1 of FIG. 5. As the light emitting area LEA is decreased, the range of the pixel average current PAC value corresponding to the pixel average current info PAI stored in the pixel average current look-up table PACLT may be decreased. For example, as the light emitting area LEA of the display panel DP is decreased, a deviation among the pixel average current info PAI for the pixels may be decreased. The pixel average current look-up table PACLT may be separately generated for each of the light emitting areas.

The method for extracting average current may compensate image degradation of the display panel DP by providing the pixel average current info PAI for each of the pixels based on the average current DAI of the display panel DP.

Figure 17:
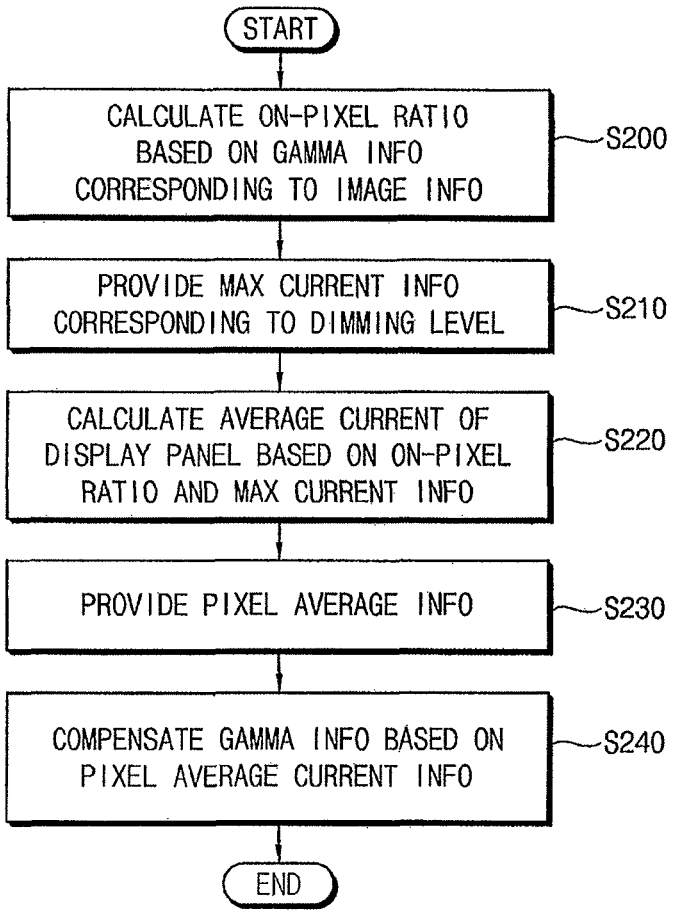
FIG. 17 illustrates illustrating an embodiment of a method for compensating image information.
Figure 18:
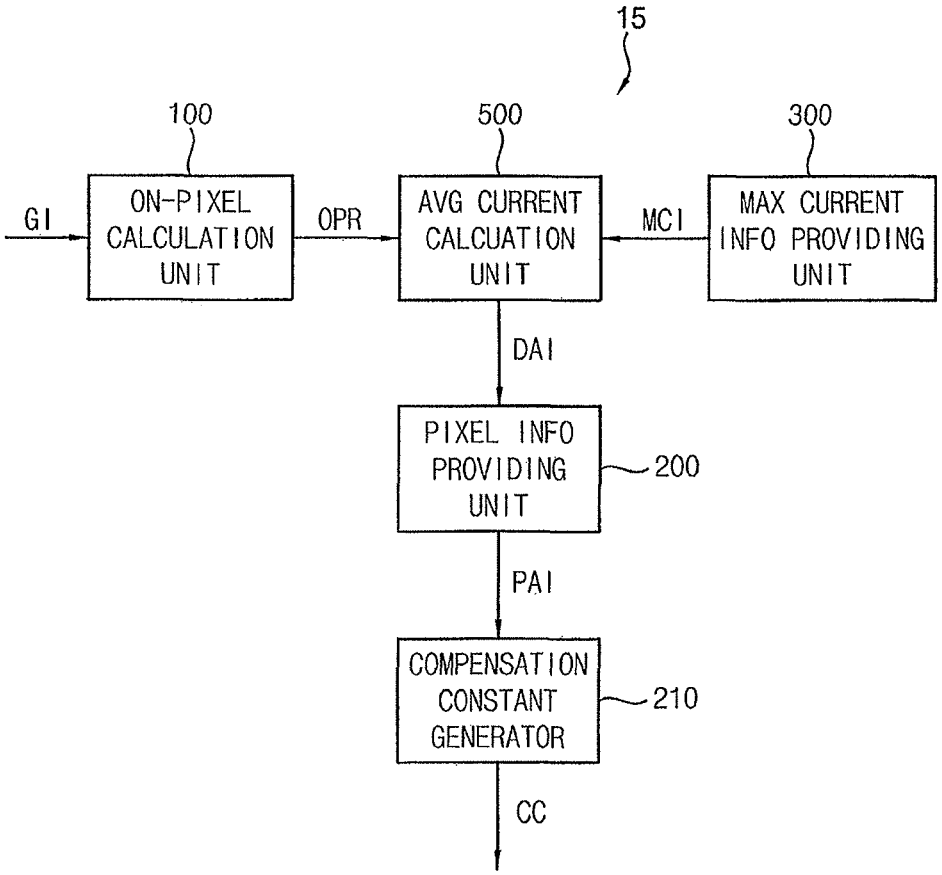
FIG. 18 illustrates an embodiment of an image information compensation device.

FIG. 17 illustrates an embodiment of a method for compensating image information, and FIG. 18 illustrates an embodiment of an image info compensation device 15. Referring to FIGS. 17 and 18, the image info compensation device 15 includes an on-pixel calculation unit 100, a max current info providing unit 300, an average current calculation unit 500, a pixel info providing unit 200 and a compensation constant generator 210.

In the method for compensating image information, the on-pixel calculation unit 100 calculates an on-pixel ratio OPR based on a gamma info GI corresponding to image info IMI (S200). The on-pixel ratio OPR corresponds to turned-on pixels among pixels in the display panel DP. The on-pixel ratio OPR corresponds to turned-on pixels among pixels included in a display panel DP. As will be described with reference to FIGS. 10 to 12, the pixels in the display panel DP may be turned-on based the gamma info GI corresponding to the image info IMI.

For example, when all pixels in the display panel DP display white color based the gamma info GI corresponding to the image info IMI, the on-pixel ratio OPR may be 1 or 100%. When half of the pixels in the display panel DP display white color based the gamma info GI corresponding to the image info IMI, the on-pixel ratio OPR may be 0.5 or 50%. When three quarters of the pixels in the display panel DP display white color based the gamma info GI corresponding to the image info IMI, the on-pixel ratio OPR may be 0.75 or 75%.

The max current info providing unit 300 provides a max current info MCI corresponding to a dimming level DL (S210). The max current info MCI may be a max current MC value corresponding to the dimming level DL. The max current info MCI of the display panel DP may be changed according to the dimming level DL of the display device including the display panel DP. As the dimming level DL is increased, the max current MC corresponding to the max current info MCI of the display panel DP may be increased. For example, when the dimming level DL is 1, the max current MC corresponding to the max current info MCI of the display panel DP may be 10. When the dimming level DL is 3, the max current MC corresponding to the max current info MCI of the display panel DP may be 100.

The average current calculation unit 500 calculates an average current DAI of the display panel DP based on the on-pixel ratio OPR and the max current info MCI (S220). The average current DAI may be a value obtained by multiplying the on-pixel ratio OPR and the max current MC value corresponding to the max current info MCI. For example, the on-pixel ratio OPR may be 1 and the dimming level DL may be 1. When the dimming level DL is 1, the max current MC corresponding to the max current info MCI may be 10. In this case, the average current DAI of the display panel DP may be 10. The value obtained by multiplying the on-pixel ratio OPR and the max current MC value corresponding to the max current info MCI may be 10.

In addition, the on-pixel ratio OPR may be 0.5 and the dimming level DL may be 1. When the dimming level DL is 1, the max current MC corresponding to the max current info MCI may be 10. In this case, the average current DAI of the display panel DP may be 5. The value obtained by multiplying the on-pixel ratio OPR and the max current MC value corresponding to the max current info MCI may be 5.

In addition, the on-pixel ratio OPR may be 0.5 and the dimming level DL may be 3. In case the dimming level DL is 3, the max current MC corresponding to the max current info MCI may be 100. In this case, the average current DAI of the display panel DP may be 50. The value obtained by multiplying the on-pixel ratio OPR and the max current MC value corresponding to the max current info MCI may be 50.

The pixel info providing unit 200 provides a pixel average current info PAI for each of the pixels (S230). The pixel average current info PAI is determined by the average current DAI of the display panel DP. The pixel average current PAC for each of the pixels may be changed according to the average current DAI of the display panel DP. When the average current DAI of the display panel DP is determined, the pixel average current PAC for each of the pixels in the display panel DP may be determined. The pixel average current info PAI for each of the pixels in the display panel DP may be stored in a pixel average current look-up table PACLT.

The gamma info GI corresponding to the image info IMI is compensated based on the pixel average current info PAI for each of the pixels (S240). In one embodiment, a display device including the display panel DP may include a compensation constant generator 210 that generates a compensation constant CC of compensating the gamma info GI based on the pixel average current info PAI for each of the pixels. For example, the gamma info GI corresponding to the image info IMI may be compensated using the compensation constant CC generated from the compensation constant generator 210.

In one embodiment, the pixel info providing unit 200 includes a pixel average current look-up table PACLT that stores the pixel average current info PAI for each of the pixels. The pixel average current info PAI in the pixel average current look-up table PACLT may be updated every a predetermined time interval PDT. The pixel average current PAC for each of the pixels may be changed according to the average current DAI of the display panel DP. When the average current DAI of the display panel DP is determined, the pixel average current PAC for each of the pixels in the display panel DP may be determined. The pixel average current info PAI for each of the pixels in the display panel DP may be stored in a pixel average current look-up table PACLT.

For example, in a first time T1, the average current extraction device 10 may update the pixel average current info PAI in the pixel average current look-up table PACLT based on a first pixel current PC1. The first pixel current PC1 may be a current transferred to the organic light-emitting diode 76 in the first time T1.

In a second time T2, the average current extraction device 10 may update the pixel average current info PAI in the pixel average current look-up table PACLT based on a second pixel current PC2. The second pixel current PC2 may be a current transferred to the organic light-emitting diode 76 in the second time T2.

In a third time T3, the average current extraction device 10 may update the pixel average current info PAI in the pixel average current look-up table PACLT based on a third pixel current PC. The third pixel current PC may be a current transferred to the organic light-emitting diode 76 in the third time T3. The time interval between the first time T1 and the second time T2 may be the predetermined time interval PDT. The time interval between the second time T2 and the third time T3 may be the predetermined time interval PDT. The time intervals may be different in another embodiment.

In one embodiment, the max current info providing unit 300 may include a max current look-up table MCLT for storing the max current info MCI corresponding to the dimming level DL. As the dimming level DL is increased, a max current MC value corresponding to the max current info MCI may be increased. The max current info MCI corresponding to the dimming level DL may be stored in the max current look-up table MCLT before the display panel DP operates.

For example, when the dimming level DL of the display device including the average current extraction device 10 is 0, the max current MC corresponding to the max current info MCI may be 0. When the dimming level DL is 1, the max current MC corresponding to the max current info MCI may be 10. When the dimming level DL is 2, the max current MC corresponding to the max current info MCI may be 50. When the dimming level DL is 3, the max current MC corresponding to the max current info MCI may be 100. Therefore, as the dimming level DL is increased, a max current MC value corresponding to the max current info MCI may be increased. The max current MC corresponding to the max current info MCI may be used as a basis for calculating the average current DAI of the display panel DP.

The method for extracting average current may compensate the image degradation of the display panel DP by providing the pixel average current info PAI for each of the pixels based on the average current DAI of the display panel DP.

Figure 19:
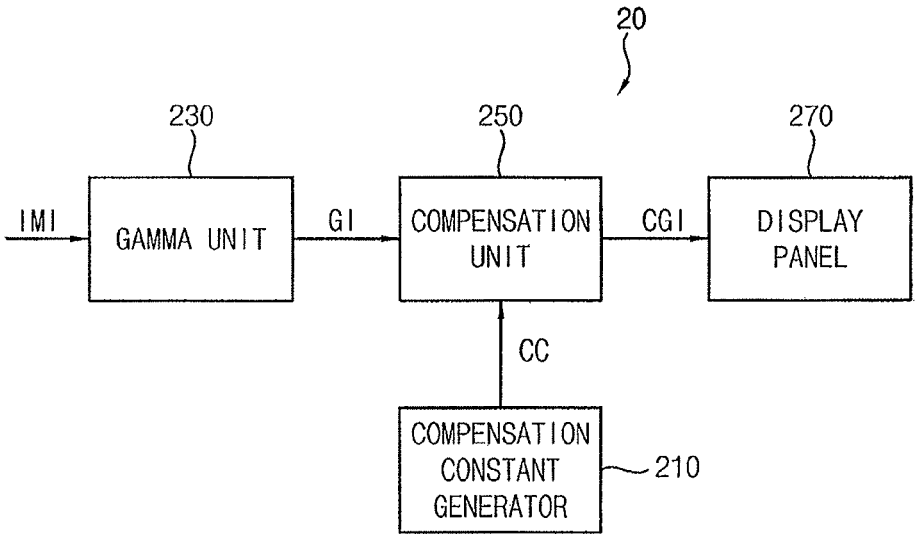
FIG. 19 illustrates an embodiment of a display device.

FIG. 19 illustrates an embodiment of a display device 20 which includes a gamma unit 230, a compensation constant generator 210, a compensation unit 250 and a display panel DP. The gamma unit 230 provides the gamma info GI corresponding to image info IMI. The compensation constant generator 210 generates the compensation constant CC that compensates the gamma info GI based on the pixel average current info PAI. The compensation unit 250 provides the compensation gamma info CGI based on the gamma info GI and the compensation constant CC. The display panel DP display an image based on the compensation gamma info CGI.

Figure 20:
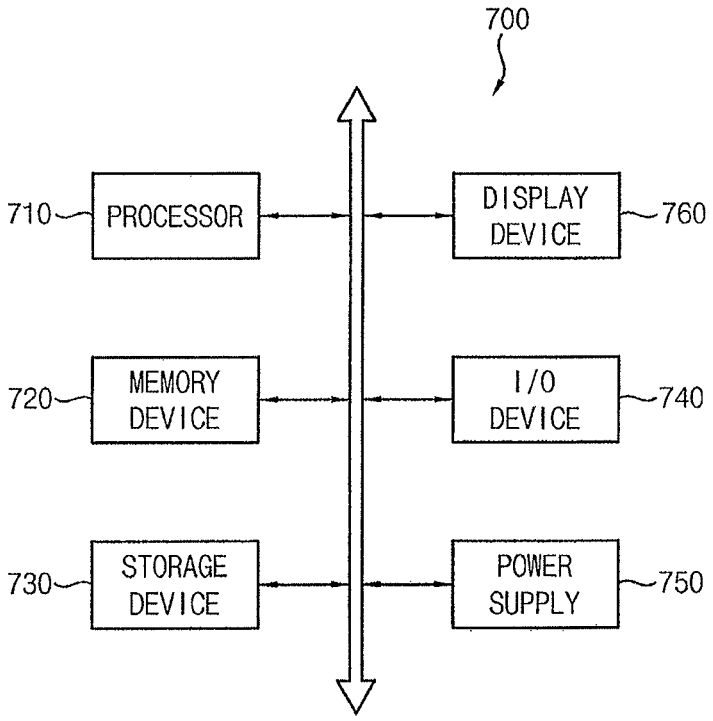
FIG. 20 illustrates an embodiment of a mobile device.

FIG. 20 illustrates an embodiment of a mobile device 700 which includes a processor 710, a memory device 720, a storage device 730, an input/output (I/O) device 740, a power supply 750, and an electroluminescent display device 760. The mobile device 700 may further include a plurality of ports for communicating a video card, a sound card, a memory card, a universal serial bus (USB) device, or other electronic systems.

The processor 710 performs various computing functions or tasks. The processor 710 may be for example, a microprocessor, a central processing unit (CPU), etc. The processor 710 may be connected to other components via an address bus, a control bus, a data bus, etc. Further, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The electroluminescent display device 760 may communicate with other components via the buses or other communication links.

The present embodiments may be applied to any mobile device or any computing device. For example, the present embodiments may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The calculation units, providing units, calculators, and other processing or control features of the disclosed embodiments may be implemented in logic which, for example, may include hardware, software, or both. When implemented at least partially in hardware, the calculation units, providing units, calculators, and other processing or control features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the embodiments described herein ay include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more embodiments, the method of extracting average current may compensate the image degradation of the display panel DP by providing the pixel average current info PAI for each of the pixels based on the average current DAI of the display panel DP.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A method for compensating image information, the method comprising:

calculating an on-pixel ratio based on gamma information corresponding to image information, the on-pixel ratio being based on turned-on pixels among a plurality of pixels in a display panel;

providing maximum current information corresponding to a dimming level of the display panel using a max current look-up table, the maximum current information corresponding to the dimming level of the display panel being stored in the max current look-up table;

calculating an average current of the display panel by multiplying the on-pixel ratio and a maximum current value corresponding to the maximum current information;

determining pixel average current information for each of the pixels based on the average current of the display panel using a pixel average current look-up table; and compensating the gamma information corresponding to the image information based on the pixel average current information for each of the pixels.

2. The method as claimed in claim 1, further comprising:

generating a compensation constant for compensating the gamma information based on the pixel average current information for each of the pixels.

3. The method as claimed in claim 1, further comprising:

storing the pixel average current information for each of the pixels in a pixel average current look-up table; and updating the pixel average current information in the pixel average current look-up table at a predetermined time interval.

4. The method as claimed in claim 1, further comprising:

storing the maximum current information corresponding to the dimming level in a maximum current look-up table, and increasing a maximum current value corresponding to the maximum current information as the dimming level increases.

* * * * *